US006784796B2

(12) United States Patent
Johnston et al.

(10) Patent No.: US 6,784,796 B2
(45) Date of Patent: Aug. 31, 2004

(54) MAGNETIC VECTOR FIELD TAG AND SEAL

(75) Inventors: Roger G. Johnston, Los Alamos, NM (US); Anthony R. E. Garcia, Espanola, NM (US)

(73) Assignee: The Regents of the University of Califronia, Los Alamos, NM (US)

( * ) Notice: Subject to any disclaimer, the term of this patent is extended or adjusted under 35 U.S.C. 154(b) by 154 days.

(21) Appl. No.: 10/046,100

(22) Filed: Nov. 6, 2001

(65) Prior Publication Data

US 2002/0171547 A1 Nov. 21, 2002

Related U.S. Application Data

(63) Continuation-in-part of application No. 09/467,668, filed on Dec. 17, 1999, now abandoned.

(51) Int. Cl.[7] ..... G08B 13/14

(52) U.S. Cl. ..... 340/568.1; 324/207.11; 340/545.6; 340/547

(58) Field of Search ..... 340/568.1, 572.1, 340/541, 547, 545.6; 335/219, 209; 600/15; 324/207.11, 207.22, 207.26; 446/444, 446, 447, 129, 131

(56) References Cited

U.S. PATENT DOCUMENTS

| | | | | | |
|---|---|---|---|---|---|
| 3,117,655 | A | | 1/1964 | Skupas et al. | 280/33.994 X |
| 3,292,080 | A | | 12/1966 | Trikilis | 340/572.1 |
| 3,317,702 | A | * | 5/1967 | Mann | 219/79 |
| 3,502,866 | A | * | 3/1970 | Biaggini | 246/2 E |
| 3,555,380 | A | * | 1/1971 | Hings | 318/135 |
| 3,636,568 | A | | 1/1972 | Stuner | 2/161.6 |
| 3,665,449 | A | | 5/1972 | Elder et al. | 340/572.1 |
| 3,688,256 | A | | 8/1972 | D'Ausilio et al. | 340/430 |
| 3,745,553 | A | | 7/1973 | Kardashian | 340/572.5 X |
| 3,871,170 | A | * | 3/1975 | Bergey | 368/69 |
| 3,927,474 | A | | 12/1975 | Lapeyre et al. | 33/356 |
| 4,480,596 | A | | 11/1984 | Shumiyashu | 600/15 |
| 4,527,153 | A | | 7/1985 | Suzuki et al. | 340/572.2 |
| 4,603,871 | A | | 8/1986 | McNeill | 280/33.994 |
| 4,798,194 | A | | 1/1989 | Amishima | 600/9 |
| 4,940,966 | A | | 7/1990 | Pettigrew et al. | 340/551 |
| 5,122,750 | A | | 6/1992 | Rippingale et al. | 324/326 |
| 5,353,015 | A | | 10/1994 | Robinson | 340/547 X |
| 5,376,921 | A | | 12/1994 | Trikilis | 340/551 |
| 5,426,925 | A | | 6/1995 | Smargiassi | 54/79.1 |
| 5,493,517 | A | | 2/1996 | Frazier | 702/33 |
| 5,565,847 | A | | 10/1996 | Gambino et al. | 340/572.6 |
| 5,719,771 | A | | 2/1998 | Buck et al. | 455/456 |
| 5,720,046 | A | * | 2/1998 | Lopez et al. | 2/159 |
| 5,729,199 | A | | 3/1998 | Cooper et al. | 340/541 |
| 5,783,944 | A | | 7/1998 | Rakijas | 324/207.22 X |
| 5,825,293 | A | | 10/1998 | Ahmed et al. | 340/573.1 |
| 5,877,685 | A | | 3/1999 | Eriksson | 340/572.1 X |
| 6,029,404 | A | | 2/2000 | Lewis | 52/2.18 |

FOREIGN PATENT DOCUMENTS

| | | |
|---|---|---|
| JP | 8117350 | 5/1996 |

* cited by examiner

*Primary Examiner*—Thomas J Mullen
(74) *Attorney, Agent, or Firm*—Samuel L. Borkowsky

(57) ABSTRACT

One or more magnets are placed in a container (preferably on objects inside the container) and the magnetic field strength and vector direction are measured with a magnetometer from at least one location near the container to provide the container with a magnetic vector field tag and seal. The location(s) of the magnetometer relative to the container are also noted. If the position of any magnet inside the container changes, then the measured vector fields at the these locations also change, indicating that the tag has been removed, the seal has broken, and therefore that the container and objects inside may have been tampered with. A hollow wheel with magnets inside may also provide a similar magnetic vector field tag and seal. As the wheel turns, the magnets tumble randomly inside, removing the tag and breaking the seal.

21 Claims, 4 Drawing Sheets

MAGNETIC VECTOR FIELD TAG AND SEAL

RELATED APPLICATIONS

This application is a continuation-in-part of U.S. application Ser. No. 09/467,668, filed Dec. 17, 1999, now abandoned, hereby incorporated by reference.

STATEMENT REGARDING FEDERAL RIGHTS

This invention was made with government support under Contract No. W-7405-ENG-36 awarded by the U.S. Department of Energy to The Regents of the University of California. The U.S. government has certain rights in the invention.

FIELD OF THE INVENTION

The present invention relates generally to tags and seals and more particularly to a magnetic vector field tag and a magnetic vector field seal and to a method for providing an object with a magnetic vector field tag and a magnetic vector field seal.

BACKGROUND OF THE INVENTION

Tags are generally used to identify and provide information relating to an object or objects, both animate and inanimate. For example, a tag can be an identification badge for a pet, a label to identify a piece of luggage, a scannable barcode to provide a manifest of items in a container, etc. Tags include cards having magnetic stripes for scanning into a reading device for credit purchases, for withdrawing cash from teller machines, for gaining access to restricted workplaces, etc.

An object can be magnetically tagged to provide it with an identifiable magnetic field signature so that it can be remotely located. For example, U.S. Pat. No. 4,940,966 to R. M. Pettigrew et al. entitled "Article Detection and/or Recognition Using Magnetic Devices," which issued Jul. 10, 1990, describes a method for magnetically tagging an object and then locating it as it moves through a pipe. Magnetic elements are attached to an object to provide the tag. The tagged object is placed into an underground pipe system. As it travels through the pipe system, it can be located using an interrogating magnetic field.

U.S. Pat. No. 5,565,847 to R. J. Gambino et al. entitled "Magnetic Tag Using Acoustic or Magnetic Interrogation," which issued Oct. 15, 1996, describes a magnetic tag that includes magnetic cantilevers of various sizes and shapes. The cantilevers are attached to the object to tag it. The tagged object is exposed to an external magnetic field to induce vibrations at the resonance frequency of a cantilever. The time-varying magnetic field produced by the vibrating cantilever is detected to identify the tagged object.

While tags are used generally to identify objects, seals are used to indicate whether an object such as a container has been, or at least may have been, tampered with. Container seals provide a detectable indication that a container break in may have occurred, and that the container and/or objects stored inside may have been tampered with. For example, U.S. Pat. 5,729,199 to M. N. Cooper et al. entitled "Security System for a Metallic Enclosure," which issued Mar. 17, 1998 describes a seal that provides an audible signal when the seal is broken. A battery operated radio-frequency transmitter unit is placed inside a metallic enclosure. The unit transmits radio signals that are detected by a receiver outside the enclosure to indicate the security status of the enclosure.

U.S. Pat. No. 3,688,256 to R. F. D'Ausilio et al. entitled "Vehicle Intrusion Alarm System," which issued Aug. 29, 1972, describes a seal that includes a magnet attached to a door of a vehicle and a nearby receiver that detects changes in magnetic field strength. When the door is opened the changing magnetic field strength near the door induces a voltage in the receiver to activate an alarm.

Sometimes, an intruder may wish to interrogate a container without stealing objects inside while avoiding detection. A successful intrusion defeats the seal by providing the intruder with important information while leaving the appearance that no intrusion has taken place.

Clearly, a method for generally providing an object with a tag and seal is highly desirable.

Therefore, an object of the present invention is a method of providing an object with a magnetic tag and seal.

Another object of the invention is a method for providing an object with a random magnetic field signature that provides the object with a tag and seal.

Yet another object of the invention is a method for providing a container with a magnetic tag to identify the container without having to open it.

Another object of the invention is an inexpensive and easily installable magnetic seal for a container.

Yet another object of the invention is a magnetic tag and seal that is difficult to detect.

Another object of the invention is a magnetic tag and seal that is difficult to defeat.

Another object of the invention is a magnetic tag and seal that can be monitored repeatedly without measurably altering the tag and seal.

Another object of the invention is a magnetic tag and seal for a container where the status of the tag and seal does not require constant monitoring.

Yet another object of the invention is a magnetic tag and seal for a container that does not require magnetic field generating devices external to the container.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as embodied and broadly described herein, the invention includes a method for providing an object with a magnetic vector field tag and seal. The method involves placing a magnetometer at a first location near an object and placing at least one magnet at a second location near the object, the magnet providing a measurable magnetic field strength at the first location of the magnetometer. The magnetometer is then used to record the magnetic field strength and vector direction at its first location to provide the object with a magnetic vector field tag and seal. The magnetometer is then moved away from the object to a location where it cannot be detected.

The invention also includes a method of providing an object with a magnetic vector field tag and seal. The method involves positioning a magnetometer at a first location near an object and placing each magnet of a plurality of magnets at a separate location near the object, the plurality of magnets providing a measurable magnetic field strength and vector direction at first location of the magnetometer. The magnetometer is then used to record the magnetic field strength and vector direction using the magnetometer at its first location to provide the object with a magnetic vector field tag and seal. The magnetometer is then moved away from the object to a location where it cannot be detected.

The invention also includes a magnetic device having a permanent magnet and a wheel having a chamber sufficiently large for receiving the magnet and allowing it to tumble randomly inside when the wheel rotates about its axis. The device also has an axle coincident with the wheel axis about which the wheel can rotate.

The invention also includes a magnetic device having a plurality of permanent magnets and a wheel having a plurality of chambers, each chamber sufficiently large to receive at least one of the magnets and allow it to tumble randomly inside when the wheel rotates about its axis. The device also has an an axle coincident with the wheel axis about which said wheel can rotate.

The invention also includes a movable tray having a permanent magnet and at least three wheels, where one of the wheels has a chamber sufficiently large to receive the magnet and allow it to tumble randomly inside when the wheel rotates about its axis. The tray includes axles for each wheel, each axle being coincident with the wheel axis about which said wheel can rotate. The tray also includes a substantially flat support having a first side for supporting objects thereupon and a second side for attaching said wheels thereto such that the support can be rolled across a surface. The tray also includes means for attaching the wheels to the support.

The invention also includes a magnetic device having a wheel having a rotational axis, the wheel comprising a magnetic material. The device also includes an axle coincident with the rotational axis of the wheel, and a track configured to receive the wheel and allow the wheel to roll and slide therein as it moves within the track.

The invention also includes a magnetic device for providing an object with a magnetic vector field tag and seal. The device includes a permanent magnet and a support for attaching the magnet thereto. The support is flexible enough that it can be wrapped around an object to provide the object with a magnetic vector field tag and seal by placing the device around the object and recording the magnetic field strength and vector direction from at least one direction near the object.

The invention also includes a magnetic device for providing an object with a magnetic vector field tag and seal. The device includes a plurality of permanent magnets and a support for attaching said magnets thereto. The support is flexible enough that it can be wrapped around an object to provide the object with a magnetic vector field tag and seal by placing the device around the object and recording the magnetic field strength and vector direction from at least one location near the object.

BRIEF DESCRIPTION OF THE DRAWINGS

The accompanying drawings, which are incorporated in and form a part of the specification, illustrate embodiments of the present invention and, together with the description, serve to explain the principles of the invention.

In the Figures.

DETAILED DESCRIPTION OF THE INVENTION

Figure 1:
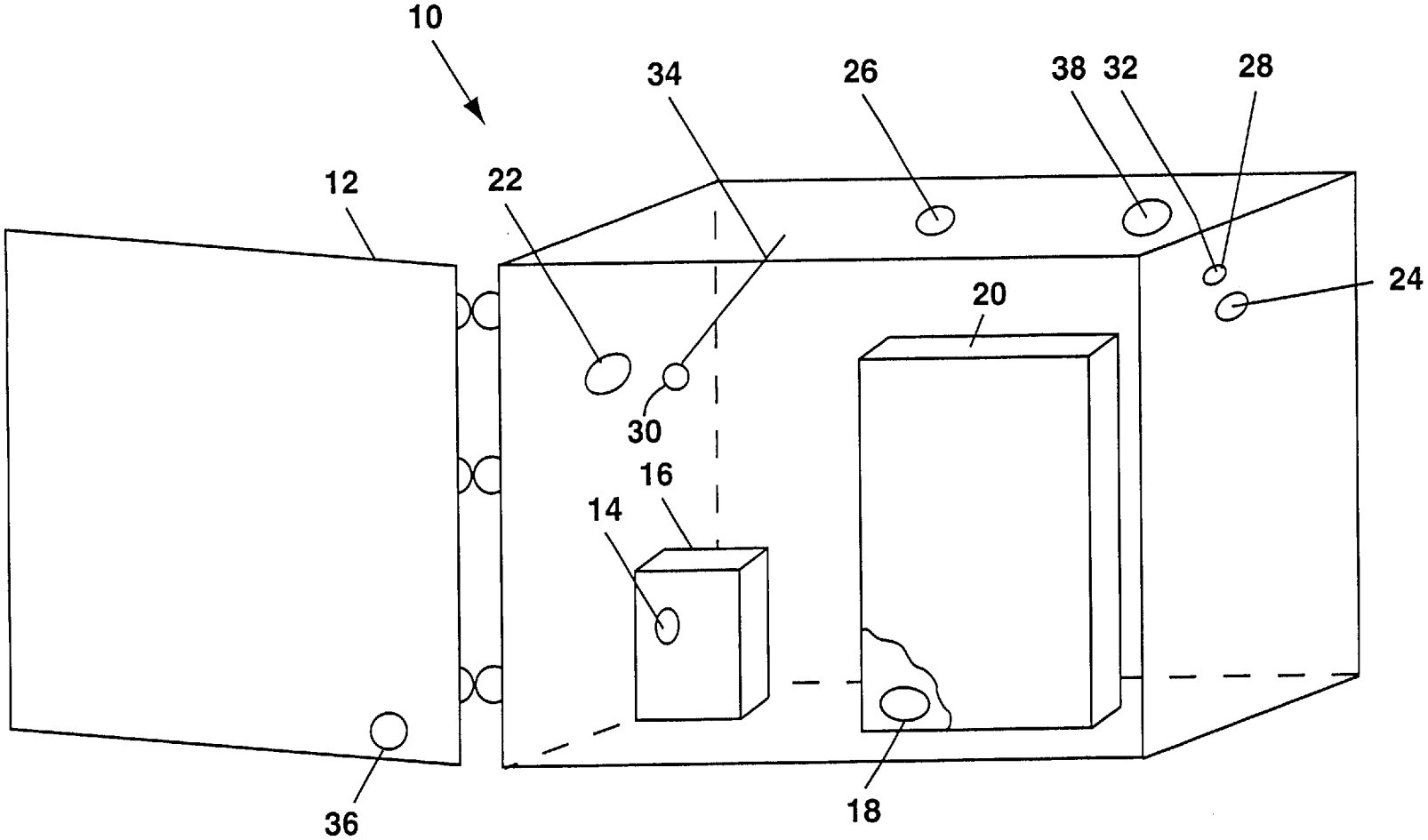
FIG. 1 is a perspective view of an open container with objects and magnetic devices inside.

Briefly, the present invention includes a method for providing an object with a magnetic tag and seal that is a three-dimensional magnetic vector field. The method includes placing magnetic devices near the object and recording the strength and sign of the magnetic field due to these devices from at least one location.

The invention provides the object with a magnetic tag since the strength and vector direction of the field due to a magnetic device or devices remains constant if the positions of the devices also remain constant. The invention also provides a magnetic seal for the object since a small change in the position of a magnetic device produces a measurable change in the field, which indicates that the magnetic seal has been broken and that object tampering may have occurred.

A variety of magnetic devices and magnetic field detectors can be used with the present invention. Gaussmeters and magnetometers are preferred detectors. A variety of gaussmeters are available. One type measures the individual components of the magnetic field along all three axes from a single location. It must be positioned very carefully and its position must be recorded very accurately. Another type measures the measure the field along only a single axis. It can be oriented separately in the three orthogonal directions for three separate field measurements at a particular location. A third type of gaussmeter measures the total magnetic vector magnitude, i.e. the vector sum of the magnetic field strength along each orthogonal axis from a single location; it does not require as careful positioning as the others.

Permanent magnets and electromagnets can be used with the invention. Permanent magnets are preferred since they are generally inexpensive, highly accessible, easy to use, and have a very long shelf life and usable lifetime. Examples of permanent magnets include flexible ferrite magnets containing magnetic powders impregnated in a binder, alnico magnets, and rare earth magnets. Rare earth magnets are preferred since they provide the strongest and most easily measurable magnetic fields. Examples of rare earth magnets are neodymium-iron-boron magnets and samarium-cobalt magnets. The table below shows how the magnetic field strength of a fully magnetized permanent magnet about 1 inch long by about 0.5 inch in diameter decreases with distance along the magnetization axis.

TABLE

| Distance from magnet | Magnetic Field Strength |
|---|---|
| 1 inch | 147,200 milligauss |
| 10 inches | 360 milligauss |
| 2 feet | 28.3 milligauss |
| 4 feet | 3.6 milligauss |
| 6 feet | 1.09 milligauss |
| 10 feet | 0.24 milligauss |

Using an inexpensive gaussmeter, changes of about 0.1 milligauss are easily detectable. Thus, small permanent magnets generate easily measurable magnetic fields, even from 10 feet. Obviously, larger permanent magnets generate stronger magnetic stronger fields and could be used to measure field strengths at greater distances relative to smaller magnets.

In the Figures that follow, we show how the method of the present invention can be used to provide a magnetic vector field tag and seal for an object. In these Figures, similar or identical structure is identified using identical callouts. FIG. 1 shows how magnetic devices could be used to provide a container with a magnetic vector field tag and seal. The devices, which include permanent magnets that can vary in size, shape, magnetic field strength, etc, can be attached to the container walls, suspending from the container ceiling, attached to objects inside the container, placed inside objects inside the container, etc. There are obviously many ways to arrange the magnetic devices. As shown, FIG. 1 includes container 10 with door 12 open to show the inside of the container. Magnet 14 is attached to object 16, and magnet 18 is inside object 20. If the magnet is a permanent magnet and the object is a made from a material that is naturally attracted to magnets, the device and object are attached via the magnetic force of attraction between them. If the object is not magnetically attracted to the device, it can be attached to the magnetic device using bolts, screws, clamps, adhesives, or other common attaching means.

FIG. 1 shows magnets 22 and 24 attached to container sidewalls and magnet 26 attached to the container ceiling. Magnets 28 and 30 are attached to one end of suspending means 32 and 34 respectively; the other ends are attached to the ceiling. Suspending means could be strings, pivotable rods, or similar means to allow the attached magnets to swing freely in a pendulum motion. As FIG. 1 shows, device 30 is magnetically attracted to device 22 and is pointing toward it. This position may have occurred by swinging device 30 until it was sufficiently near magnet 22 such that the magnetic force of attraction overcame the gravitation force which would pull magnet 30 perpendicular to the ground. Similarly, suspended magnet 28 is shown pointing toward magnet 24.

Magnet 36 is attached to door 12; when the door is closed, magnet 36 is inside the container. Magnet 38 is outside the container. Additional magnets, not shown, can also be suspended, attached to objects in the container, placed inside objects in the container, etc.

After positioning the magnets and locking the container door, the magnetic vector field strength at various locations is measured. The magnetic vector field strength could be measured at locations inside the container, outside the container, or both. For example, a magnetometer can be positioned at one location and the field strength and vector direction measured from there to provide the tag and seal. After taking the measurement, the magnetometer is moved to a location away from the container where it cannot be detected. The magnetometer is not attached to the container and does not continuously monitor the magnetic vector field strength as described in, for example, U.S. Pat. No. 3,745,553 to V. S. Kardashian, issued Jul. 10, 1973. After recording the magnetic field strength and vector direction, the magnetometer may be placed in storage, or in some other location where it cannot be detected. While attachment of the magnetometer facilitates measuring the magnetic field from a particular location, there are several important reasons for not using an attached magnetometer. First, an attached magnetometer may detect changes in the magnetic field that are not due to tampering but due simply to movement of the container with respect to the earth's magnetic field as the container is being transported, thereby generating false alarms. Second, an attached magnetometer may detect non-tampering events involving the temporary introduction of electromagnets, motors, man-made permanent magnets, and the like, near the magnetometer that would also generate false alarms. Third, an attached magnetometer must be designed to continually tolerate potentially harsh environmental conditions (for magnetometers attached to the outside of a container and exposed to the environment). Fourth, an attached magnetometer that monitors continuously must have a continuous source of power, which can be impractical for containers in transit or for long term monitoring. Fifth, an attached magnetometer must be supplied for each and every container. Fifth, an attached magnetometer can itself be tampered with by, for example, blocking the alarm signal, erasing the stored baseline magnetic field value, interfering with the mechanism for measuring the magnetic field, and the like. Sixth, and perhaps most important, an attached magnetometer can itself be tampered with by, for example, blocking the alarm signal, erasing the stored baseline magnetic field value, interfering with the mechanism for measuring the magnetic field, and the like. A skilled intruder who recognizes an attached magnetometer could tamper with the magnetometer directly and defeat the system without even opening the container. The invention does not include attached magnetometers and thus avoids the above disadvantages. While it is unlikely that the invention will alert a possible tampering event as it occurs, since there are no attached magnetometers to attack with the present invention, it is difficult to imagine how any tampering event can go undetected.

The number of recorded measurements, each at a different location, for a highly effective tag and seal depends on the size of the container, the number of magnets used, the individual field strengths of these magnets, and the range and sensitivity of the gaussmeter. A single magnet and a single measurement can provide the seal and tag of the present invention. However, several magnets and measurements are generally preferred since the vector field generated by a plurality of spatially distributed dipole magnets with arbitrary orientations and magnetic field strengths cannot be duplicated using a single dipole magnet. However, if only a single magnet was available, optimal placement strategies should be considered. For example, a single magnet can be attached to a large object that blocks access to likely objects of interest. When an intruder moves the large object to access the others, the intruder will have difficulty restoring the position of the large object to regain the seal and avoid detection.

Relatively weak permanent magnets may not be sufficient to provide a measurable field outside large containers, such as transportable containers for a truck. Large containers may require strong rare earth magnets and several magnetic field measurements at very different locations to provide a tag and seal for the entire container.

Figure 2:
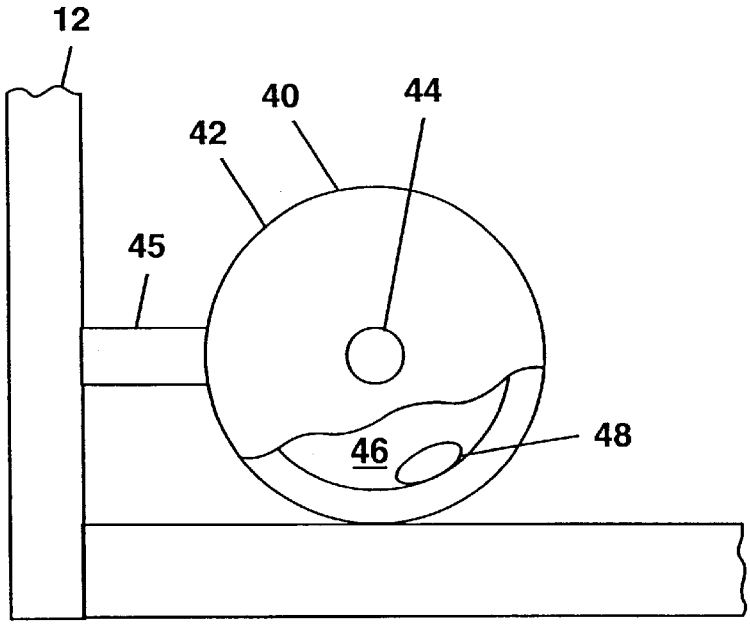
FIG. 2 shows a partially cutaway perspective side view of a hollow wheel device with a magnet inside the wheel.

A partially cutaway perspective side view of another magnetic device that can be used with the present invention is shown in FIG. 2. Magnet device 40 includes wheel 42 and axle 44. Wheel 42 has a hollow portion 46 large enough to accommodate magnet 48 and allow magnet 48 to tumble randomly inside as wheel 42 spins about axle 44. As shown in the figure, device 40 can be used by connecting axle 44 to door 12 of container 10 via connecting member 45 such that wheel 42 rests on the container floor. When door 12 is opened or closed, wheel 42 rolls on the floor and magnet 48 tumbles randomly inside. Although the position of wheel 42 does not change when the door is closed, magnet 48 will tumble randomly when the door is opened and then shut, which breaks the magnetic seal for the container. Magnet 48 may have complex morphology such as having multiple external facets to increase the complexity with which magnet 48 tumbles. Similarly, wheel 42 may include an inner uneven surface, and other non-magnetic objects, not shown, inside hollow portion 46 with magnet 48. Most importantly, random tumbling of the magnet 48 provides a magnetic seal to the container that breaks every time the container door is opened.

Figure 3:
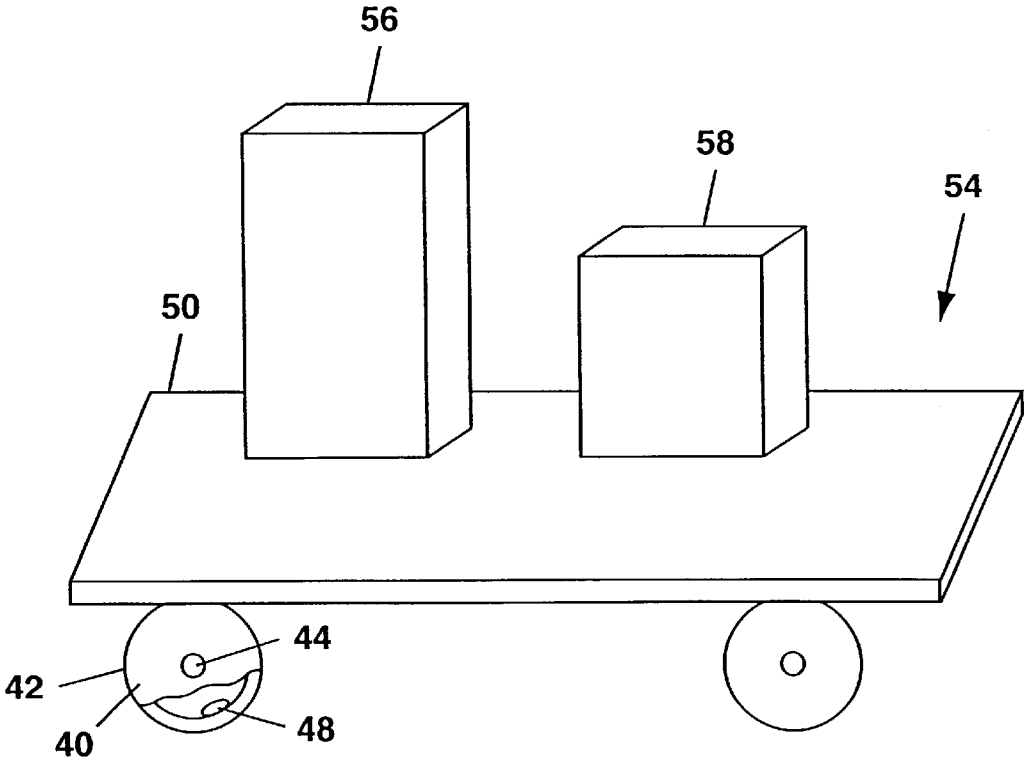
FIG. 3 is a perspective view of a tray including the wheel of FIG. 2.
Figure 4:
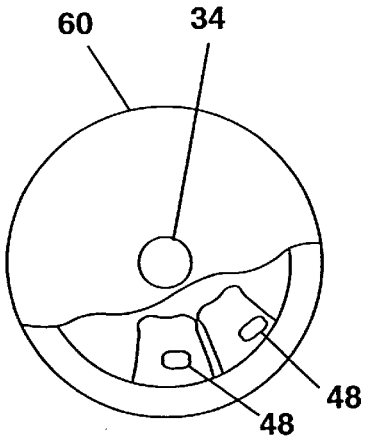
FIG. 4 shows a partially cutaway perspective side view of a hollow wheel device having a plurality of magnets inside.

Magnet 40 may be attached to a supporting member 50 via connecting member 45 to provide tray 54, as shown in FIG. 3. Tray 54 is sturdy enough to support objects, such as objects 56 and 58, and can be rolled inside container 10. After closing the container door, the magnetic field strength outside the container can be measured as previously described to provide the container with a magnetic vector field tag and seal. If an intruder opens the door and rolls the tray, magnet 48 randomly tumbles inside wheel 42 and breaks the magnetic seal. A wheel having a plurality of magnets can also be used. FIG. 4 shows wheel 60 having a plurality of chambers and magnets. Wheels 42 and 60 can be made using opaque materials that are not attracted to magnets, such as aluminum, so that the intruder cannot see the magnets inside and wouldn't realize that he cannot avoid detection by rolling the tray back to its original position.

Figure 5:
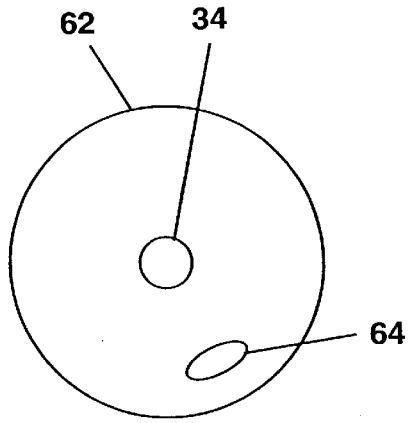
FIG. 5 shows a side view of a wheel device having an attached magnet.
Figure 6A:
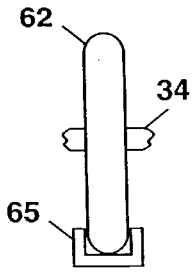
FIGS. 6*a*–6*b* show end-on views of a wheel on a track.
Figure 6B:
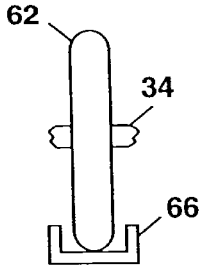

Other wheel embodiments that can also be used include wheels made entirely of magnetic materials, or non-magnetic wheels having attached magnets. FIG. 5 shows wheel 62 having axle 34 and attached magnet 64. If allowed simply to roll, returning wheel 62 to its original position should restore the original seal. However, randomization of the magnetic orientation would occur if wheel 62 were forced to both roll and slide before it is restored to its original position. This can be accomplished, for example, by undersizing the diameter of the axle so that the wheel can wobble as it spins about its axle. Alternatively, an oversized track can allow wheel 62 to occasionally slide as it rolls along the track. FIG. 6*a* shows an end view wheel 62 inside track 65. Here, the tight fit of the wheel in the track minimizes sliding in the track. In contrast, FIG. 6*b* shows wheel 62 fitting loosely inside track 66. This loose fit allows wheel 62 to wobble and slide as it rolls along track 66. This wobbling feature can also be used with device 40 of FIG. 2, and device 60 of FIG. 4.

Figure 7:
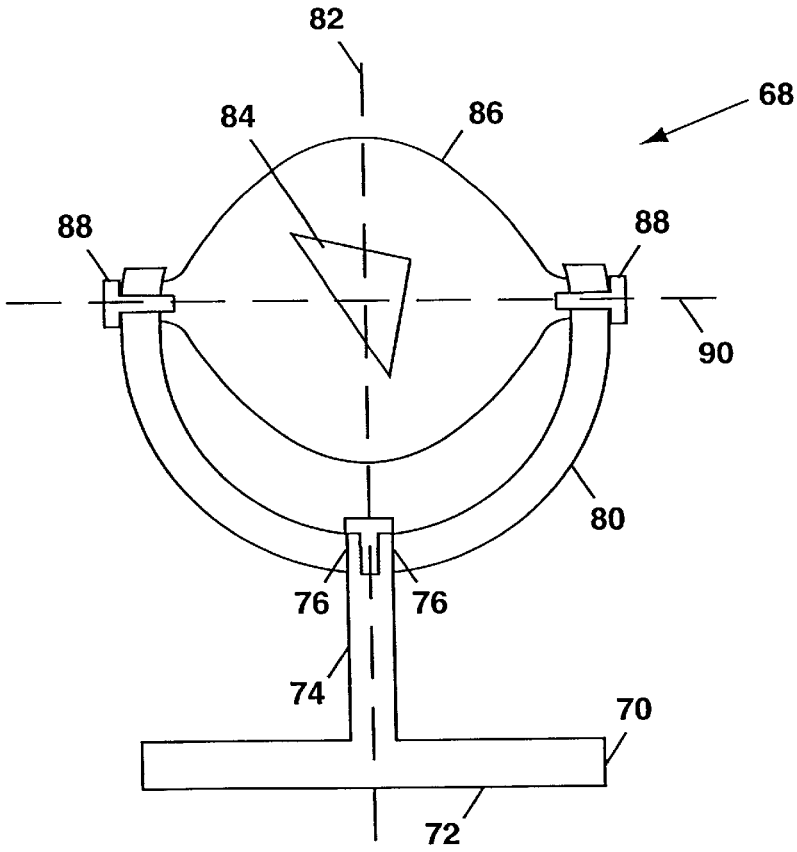
FIG. 7 shows a cross-sectional side view of a gimbal device.

Magnetic devices employing gimbals that allow magnets to rotate freely in any direction can be used with the present invention. FIG. 7 shows a cross-sectional side view of an example of such a device. Gimbal device 68 includes a base 70 having a mounting portion 72 and a shaft portion 74. The end portion 76 of shaft portion 74 is configured to receive slot 78 of gimbal 80 so that gimbal 80 can freely rotate about first axis 82. Magnetic element 84 is attached to support 86, which rotatably engages gimbal 80 via connectors 88, so that support 86 and attached magnetic element 84 may freely rotate within gimbal 80 about second axis 90.

Mounting portion 72 of gimbal device 68 can be attached to an object, such as the inside of a container and/or to objects inside according to the method of the present invention to provide the container with a magnetic vector field tag and seal. For example, gimbal device 68 can be attached to a container door, and after closing the door, the field strength can be recorded to provide the tag and seal. If the door is then opened, magnetic element 84 moves about shaft portion 74 and/or axis 82 to break the magnetic seal for the container.

Alternatively, a strong permanent magnet can be attached to the container door, and at least one gimbal device 68 can be placed inside. If sufficiently close, the door magnet exerts a force on the gimbal when the door is opened or closed to cause rotation of magnetic element b 84of gimbal device 68. The frictional resistance to rotation of gimbal 80 may be adjusted to provide randomness in the amount of its rotation.

The number of gimbal devices 68 sufficient to provide the container with a tag and seal depends on the size and shape of the container, the magnetic field strengths of the gimbal devices, and their placement inside the container. Intelligent placement of the gimbal devices may reduce the number required for an effective tag and seal.

A magnetic tag and seal employing several interacting gimbal devices would be nearly impossible to restore once the seal has been broken. This type of seal is most effective for relatively small containers (e.g. 4 ft×4 ft×4 ft) since the magnetic elements 84 of gimbal devices 68 are typically small magnets that do not provide strong magnetic fields. Gimbal devices 68 may be attached to the door, walls, and objects inside the container. Device placement is chosen such that as the door moves, the moving door gimbal exerts a magnetic force on at least one other gimbal device sufficient to reorient its associated magnetic element 84. This movement could start a chain reaction resulting in reorientation of all gimbal devices in the container to the lowest energy configuration, or more likely to a "metastable" configuration. A metastable configuration is not the lowest possible energy configuration but is low enough so that it persists without reorienting to the lowest energy configuration.

Occasionally, it is desirable to "reset" the tag and seal, i.e. to provide the container with a new magnetic tag and seal. This can be done without opening the container by moving a strong magnet along the outside of the container. If the gimbal devices 68 are functioning properly, they should reorient to a different metastable configuration and provide the container with a different magnetic vector field tag and seal.

Figure 8:
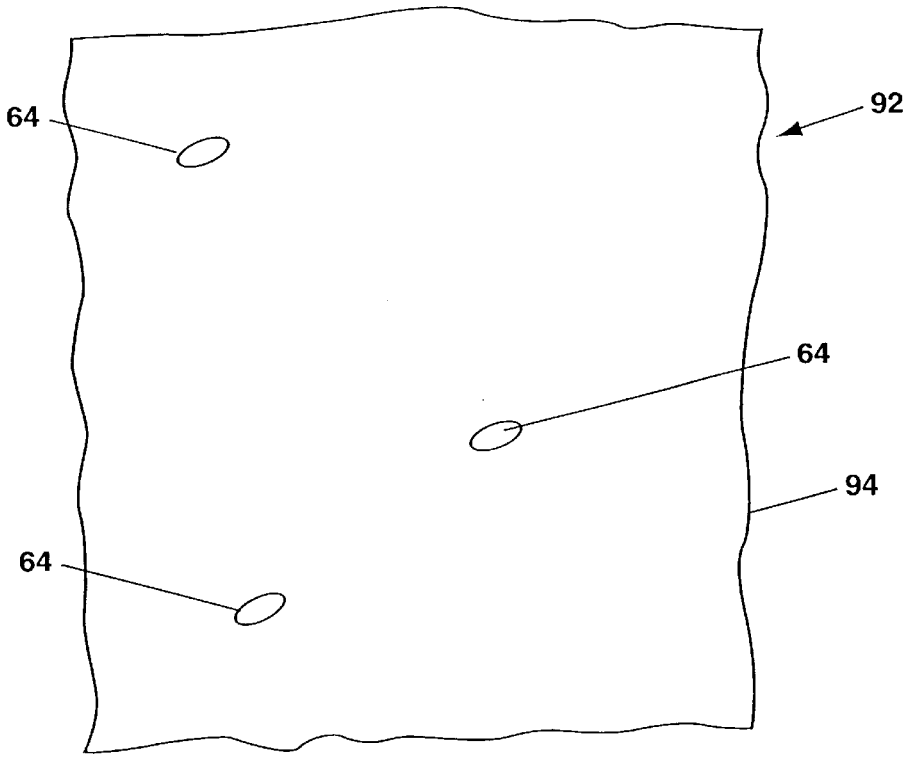
FIG. 8 shows a perspective view of a cover having attached magnets.

Another magnetic device that can be used with the present invention is shown in FIG. 8. Flexible magnetic device 92 includes a flexible support 94 and at least one magnetic element 64 attached to support 94. Support 94 can be plastic, cloth, or other material sufficiently flexible such that device 92 can be wrapped around an object. After wrapping and securing device 92 to the object, the field from at least one location outside the object is then measured. If the device is removed to access the object, it will be difficult to rewrap it to restore the original magnetic field. The wrapped object can be inside a container, but need not be.

Figure 9:
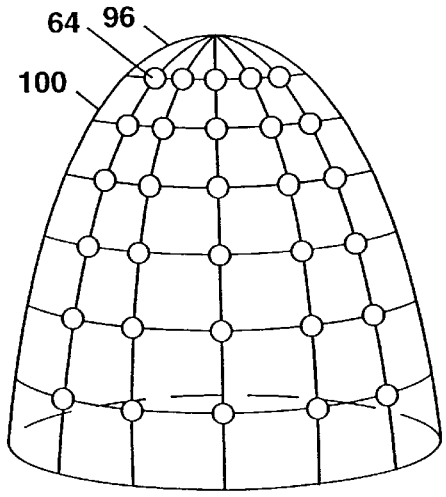
FIG. 9 shows a perspective view of a magnetic cage.

FIG. 9 shows a perspective view of magnetic cage 96. Magnetic devices 64 are attached to web support 100 to provide a magnetic cage. Any object inside the cage that is too small to fit through largest opening in the cage cannot be removed from the cage without moving at least one magnet 64 to break the magnetic seal.

The tag and seal for a container according to the present invention would persist when the container is moved if the relative positions of the magnetic devices used do not change. The magnetic field can be measured from the same positions relative to the container as before and, if necessary, correct for a slightly background field due to a different angle and/or magnitude of the earth's magnetic field.

The above examples of the present invention have been presented for purposes of illustration and description and are not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for providing a container that contains one or more objects with a magnetic vector field tag and seal, comprising the steps of:

(a) placing a magnetometer at a first location relative to the container;

(b) placing at least one magnet inside the container, the magnet providing a measurable magnetic field strength and vector direction at the first location of the magnetometer;

(c) measuring the magnetic field strength and vector direction at the first location using the magnetometer to provide the container with a magnetic vector field tag and seal; and (d) removing the magnetometer.

2. The method of claim 1, wherein the at least one magnet comprises a permanent magnet.

3. The method of claim 1, wherein the at least one magnet comprises an electromagnet.

4. The method of claim 1, wherein the at least one magnet is placed on at least one object in the container.

5. The method of claim 1, wherein the magnetic field strength and vector direction are measured from inside the container.

6. The method of claim 1, wherein the magnetic field strength and vector direction are measured from outside the container.

7. The method of claim 1, further comprising repositioning the at least one magnet by exposing it to a magnetic force, thereby changing the measured magnetic strength and vector direction at the first location, thereafter measuring the new magnetic strength and vector direction at the first location, and thereafter removing the magnetometer.

8. The method of claim 1, wherein the magnet comprises a magnet rotatably engaged to a gimbal.

9. A method of providing a container filled with one or more objects with a magnetic vector field tag and seal, comprising the steps of:

(a) positioning a magnetometer at a first location relative to the container;

(b) placing a plurality of magnets inside the container, the plurality of magnets providing a measurable magnetic field strength and vector direction at the first location of the magnetometer;

(c) measuring the strength and vector direction of the magnetic field at the first location using the magnetometer to provide the container with a magnetic vector field tag and seal; and (d) removing the magnetometer.

10. The method of claim 9, wherein at least one magnet of the plurality of magnets comprises a permanent magnet.

11. The method of claim 9, wherein at least one magnet of the plurality of magnets comprises an electromagnet.

12. The method of claim 9, wherein at least one of the plurality of magnets is placed on at least one object inside the container.

13. The method of claim 9, wherein the magnetic field strength and vector direction are measured from inside the container.

14. The method of claim 9, wherein the magnetic field strength and vector direction are measured from outside the container.

15. The method of claim 9, further comprising repositioning at least one of the plurality of magnets by exposing the plurality of magnets to a magnetic force, thereby changing the measured magnetic strength and vector direction at the first location, thereafter measuring the new magnetic strength and vector direction at the first location, and thereafter removing the magnetometer.

16. The method of claim 9, wherein at least one of the plurality of magnets comprises a magnet rotatably engaged to a gimbal.

17. A magnetic device, comprising:

(a) a permanent magnet;

(b) a wheel having a chamber sufficiently large for receiving said magnet and allowing it to tumble randomly inside when the wheel rotates about its axis; and (c) an axle coincident with the wheel axis about which said wheel can rotate.

18. A magnetic device, comprising:

(a) a plurality of permanent magnets;

(b) a wheel having a plurality of chambers, each chamber sufficiently large to receive at least one of the magnets and allow it to tumble randomly inside when the wheel rotates about its axis; and (c) an axle coincident with the wheel axis about which said wheel can rotate.

19. A movable tray, comprising:

(a) a permanent magnet;

(b) at least three wheels, one of said wheels having a chamber sufficiently large to receive the magnet and allow it to tumble randomly inside when the wheel rotates about its axis;

(c) axles for each wheel, each axle being coincident with the wheel axis about which said wheel can rotate;

(d) a substantially flat support having a first side for supporting objects thereupon and a second side for attaching said wheels thereto such that the support can be rolled across a surface; and (e) means for attaching said wheels to the support.

20. The tray of claim 19, wherein at least two of said wheels each comprise a chamber large enough to receive a magnet and allow it to tumble randomly when the tray is rolled across a surface, and further comprising at least one additional magnet inside each additional chamber large enough to receive said magnet and allow it to tumble randomly therein.

21. A method for providing a stationary object with a magnetic vector field tag and seal, comprising:

(a) providing a device comprising a plurality of permanent magnets attached to a flexible support that can be wrapped around a stationary object; and (b) wrapping the device around the object, and measuring the magnetic field strength and vector direction from at least one location near the object.

* * * * *